US006571423B1

(12) United States Patent
Lijzenga et al.

(10) Patent No.: US 6,571,423 B1
(45) Date of Patent: Jun. 3, 2003

(54) SURFACE-CLEANING DEVICE WITH ROTATABLE AND PIVOTABLE CLEANING PART

(75) Inventors: Henk Lijzenga, Hoogeveen (NL); Benjamin Luurt Oudman, Sleen (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 23 days.

(21) Appl. No.: 09/644,149

(22) Filed: Aug. 23, 2000

(30) Foreign Application Priority Data

Aug. 25, 1999 (EP) ..... 99202752

(51) Int. Cl.[7] ..... A47L 7/02

(52) U.S. Cl. ..... 15/385; 15/392; 15/371; 15/87; 15/98

(58) Field of Search ..... 15/385, 388, 392, 15/371, 369, 87, 98, 49.1

(56) References Cited

U.S. PATENT DOCUMENTS 2,655,678 A * 10/1953 Keogh ..... 15/87
4,910,826 A * 3/1990 Rones ..... 15/230
5,027,470 A * 7/1991 Takashima ..... 15/385
5,259,085 A * 11/1993 Marafante et al. ..... 15/230
5,849,097 A * 12/1998 Windmeisser ..... 15/49.1

* cited by examiner

*Primary Examiner*—Theresa T. Snider
(74) *Attorney, Agent, or Firm*—Ernestine C. Bartlett

(57) ABSTRACT

The invention relates to a surface-cleaning device (61, 63) which has a base part (69) and a cleaning part (67) having a substantially flat contact surface (71) for contact with a surface (41) to be cleaned and which is rotatable relative to the base part about an axis of rotation (77) extending substantially perpendicularly to the contact surface. According to the invention, the cleaning part is pivotable relative to the base part about a pivot axis (105) which extends transversely to the axis of rotation, and the base part is so constructed that a component (93) is present and exerts a pre-tension force, preferably a pre-tension torque ($M_p$) on the cleaning part about said pivot axis. As a result, the contact surface is substantially completely in contact with the surface to be cleaned, and, when the surface-cleaning device is moved over the surface to be cleaned, the cleaning part automatically rotates about the axis of rotation under the influence of a friction force (W) present between the surface to be cleaned and the contact surface.

In a preferred embodiment, the component (93) for exerting the pre-tension torque has a roller member (95) which bears upon a roller track (99) of the cleaning part (67) under the influence of a pre-tension force (F).

The surface-cleaning device according to the invention is used in a vacuum cleaner according to the invention, wherein the surface-cleaning device is accommodated in a suction attachment to increase the cleaning performance of the vacuum cleaner.

20 Claims, 6 Drawing Sheets

SURFACE-CLEANING DEVICE WITH ROTATABLE AND PIVOTABLE CLEANING PART

BACKGROUND OF THE INVENTION

The invention relates to a surface-cleaning device comprising a base part and a cleaning part which is provided with a substantially flat contact surface for making contact with a surface to be cleaned and which is journaled so as to be rotatable relative to the base part about an axis of rotation which extends substantially perpendicularly to the contact surface.

The invention also relates to a vacuum cleaner provided with a housing in which a suction unit is present and with a suction attachment which is coupled to the suction unit via a suction channel and is provided with a surface-cleaning device, which surface-cleaning device comprises a base part and a cleaning part which is provided with a substantially flat contact surface for contact with a surface to be cleaned and which is journaled so as to be rotatable relative to the base part about an axis of rotation which extends substantially perpendicularly to the contact surface.

The invention further relates to a cleaning element suitable for use in a surface-cleaning device according to the invention.

A suction attachment of the Japanese brand National with type designation AMC-MS1 available on the Japanese market is provided with two surface-cleaning devices of the kind mentioned in the opening paragraphs arranged next to one another and is suitable for use in a vacuum cleaner of the kind mentioned in the opening paragraphs. FIG. 1*a* is a diagrammatic plan view of the known suction attachment 1, and FIG. 1*b* is a diagrammatic cross-section taken on the line I*b*—I*b* in FIG. 1*a*. The cleaning part 3 of the surface-cleaning devices 5 of the known suction attachment 1 comprises a disc-shaped holder 7 which is provided with a bearing journal 11 built up from elastic tongues 9. The holder 7 is detachably fastened to a bearing bush 13, which is accessible from a lower side 15 of the suction attachment 1, by means of the bearing journal 11 and is rotatably journaled in the bearing bush 13 relative to the suction attachment 1. A disc-shaped cleaning cloth 19 is fastened to a lower side 17 of the holder 7, on which cloth the contact surface 21, circular in shape, is present. The axis of rotation 23 of the cleaning part 3 encloses a small angle $\alpha$ of a few degrees with a perpendicular 27 on the surface 25 to be cleaned in an operational position of the suction attachment 1 on the surface 25 to be cleaned, so that a portion 31 of the contact surface 21 present adjacent a circumference 29 of the contact surface 21 of the cleaning cloth 19 is in contact with the surface 25 to be cleaned. When the suction attachment 1 is displaced over the surface 25 to be cleaned in a displacement direction X by a user, the cleaning parts 3 are rotated about their axes of rotation 23 in a direction R shown in FIG. 1*a* under the influence of friction forces F exerted on the parts 31 by the surface 25 to be cleaned. The rotating cleaning cloths 19 have a cleaning effect which supplements a cleaning effect provided by the suction attachment 1 as a result of an underpressure present in the suction attachment 1. Since the cleaning parts 3 of the known. suction attachment 1 are rotated under, the influence of said friction forces, the known suction attachment 1 need not have any driving means for driving the cleaning parts 3.

A disadvantage of the surface-cleaning devices 5 used in the known suction attachment 1 is that exclusively said portions 31 of the cleaning cloths 19 are in contact with the surface 25 to be cleaned. The result is that only a small portion of the surface 25 present below the suction attachment 1 is treated by the cleaning cloths 19. In addition, only an annular portion 33 of each cleaning cloth 19 extending along the circumference 29 is utilized for cleaning the surface 25, and a comparatively large central portion 35 of the cleaning cloth 19 remains unused.

SUMMARY OF THE INVENTION

It is an object of the invention to provide a surface-cleaning device and a vacuum cleaner of the kinds mentioned in the opening paragraphs wherein the cleaning part is also rotatable about the axis of rotation without driving means, but wherein the contact surface of the cleaning part is in substantially full contact with the surface to be cleaned.

To achieve this object, a surface-cleaning device according to the invention is characterized in that the cleaning part is pivotable relative to the base part about a pivot axis which extends transversely to the axis of rotation, while the base part is provided with means for exerting a pre-tension torque on the cleaning part about said pivot axis.

To achieve this object, a vacuum cleaner according to the invention is characterized in that the surface-cleaning device used therein is a surface-cleaning device according to the invention.

When the surface-cleaning device according to the invention is placed on the surface to be cleaned, the cleaning part is pivoted through contact with the surface to be cleaned about said pivot axis into a position in which the contact surface is directed substantially parallel to the surface to be cleaned and is accordingly in substantially full contact with the surface to be cleaned. Since said means exert a pre-tension torque on the cleaning part about the pivot axis, the contact surface exerts a surface pressure on the surface to be cleaned which is asymmetrical relative to the pivot axis, so that a displacement of the surface-cleaning device over the surface to be cleaned generates a friction force between the contact surface and the surface to be cleaned which is also asymmetrically distributed relative to the pivot axis. A suitable position of the pivot axis with respect to the axis of rotation of the cleaning part, for example a position in which the pivot axis intersects the axis of rotation or the pivot axis lies at a comparatively small distance from the axis of rotation, achieves that said friction force is also asymmetrically distributed with respect to the axis of rotation, so that the cleaning part is rotated about the axis of rotation under the influence of the friction force. Since the contact surface is in substantially full contact with the surface to be cleaned, the contact surface is substantially completely utilized for cleaning the surface to be cleaned during rotation.

A special embodiment of a surface-cleaning device according to the invention is characterized in that said means comprise a roller member which is rotatable about a further axis of rotation extending transversely to the axis of rotation and which bears with pre-tension on a roller track of the cleaning part, which roller track extends substantially parallel to the contact surface. A practical and simple construction of said means is obtained thereby, wherein wear of said means is limited as much as possible.

A further embodiment of a surface-cleaning device according to the invention is characterized in that said means comprise a wire spring, and the roller member is rotatably journaled around said wire spring adjacent an end of said wire spring. A practical and simple bearing for the roller member is thus provided, said means comprising only a limited number of components.

A yet further embodiment of a surface-cleaning device according to the invention is characterized in that the cleaning part is journaled with radial clearance in a bearing bush of the base part, and the base part is provided adjacent the bearing bush with a support ring which extends substantially perpendicularly to the axis of rotation and which serves to support the cleaning part in a direction parallel to the axis of rotation. Said support ring is provided, for example, on an end of the bearing bush. The use of said radial clearance renders the cleaning part pivotable about a support point which is present on the support ring approximately diametrically opposite a point of application of a pre-tension force arising from the pre-tension torque, as seen relative to the axis of rotation. The required pivoting possibility of the cleaning part is thus obtained by means of a particularly simple and practical construction.

A particular embodiment of a surface-cleaning device according to the invention is characterized in that the cleaning part is provided with a holder which is journaled so as to be rotatable about the axis of rotation relative to the base part, and with a cleaning element which is detachably fastened to the holder and is provided with the contact surface. This renders it possible to remove the cleaning element from the holder after use, for example in order to be cleaned or replaced with a new cleaning element.

A special embodiment of a vacuum cleaner according to the invention is characterized in that the suction channel comprises a suction tube which is pivotable about a pivot axis with respect to the suction attachment, which pivot axis extends substantially parallel to a front edge of the suction attachment and lies between the front edge and the axis of rotation of the cleaning part. When the suction attachment is moved over the surface to be cleaned, the user exerts a propelling force on the suction tube which usually comprises not only a horizontal component but also a vertical component and which is transmitted to the suction attachment at the area of said pivot axis. Since said pivot axis lies between the front edge of the suction attachment and the axis of rotation of the cleaning part, the suction attachment is supported by the front edge and the cleaning part in a stable manner, and undesirable rocking movements of the suction attachment under the influence of the vertical component of the propelling force are prevented.

According to the invention, a cleaning element suitable for use in a surface-cleaning device according to the invention, in which the cleaning part is provided with a holder with a detachable cleaning element, is characterized in that the cleaning element is provided at least with a first layer of cleaning cloth with a short-hair contact surface and a second layer of adhesive material for adhering the cleaning element to the holder. The cleaning element thus has a practical and simple layered structure. Since the contact surface is short-haired, a surface pressure distribution is obtained between the contact surface and the surface to be cleaned which leads to a particularly effective drive of the cleaning part about its axis of rotation.

A special embodiment of a cleaning element according to the invention is characterized in that the cleaning element comprises a third layer of support material interposed between the first layer and the second layer. The cleaning element as a result has a comparatively high stiffness, so that the cleaning element is easy to handle during its removal from the holder and its mounting on the holder.

A further embodiment of a cleaning element according to the invention is characterized in that the cleaning cloth is made from a microfiber material. A cleaning cloth manufactured from microfiber material is particularly suitable for use in a surface-cleaning device according to the invention because such a cleaning cloth was found to have a particularly good cleaning effect especially in the case of rotary movements of the cleaning cloth.

A yet further embodiment of a cleaning element according to the invention is characterized in that the adhesive material comprises velour for adhesion to a Velcro-like material provided on the holder. This allows the cleaning element to be provided on the holder in a particularly simple and reliable manner and to be detached from the holder in a particularly simple manner.

BRIEF DESCRIPTION OF THE DRAWINGS

The invention will be explained in more detail below with reference to the drawing, in which.

DESCRIPTION OF THE PREFERRED EMBODIMENTS

Figure 1A:
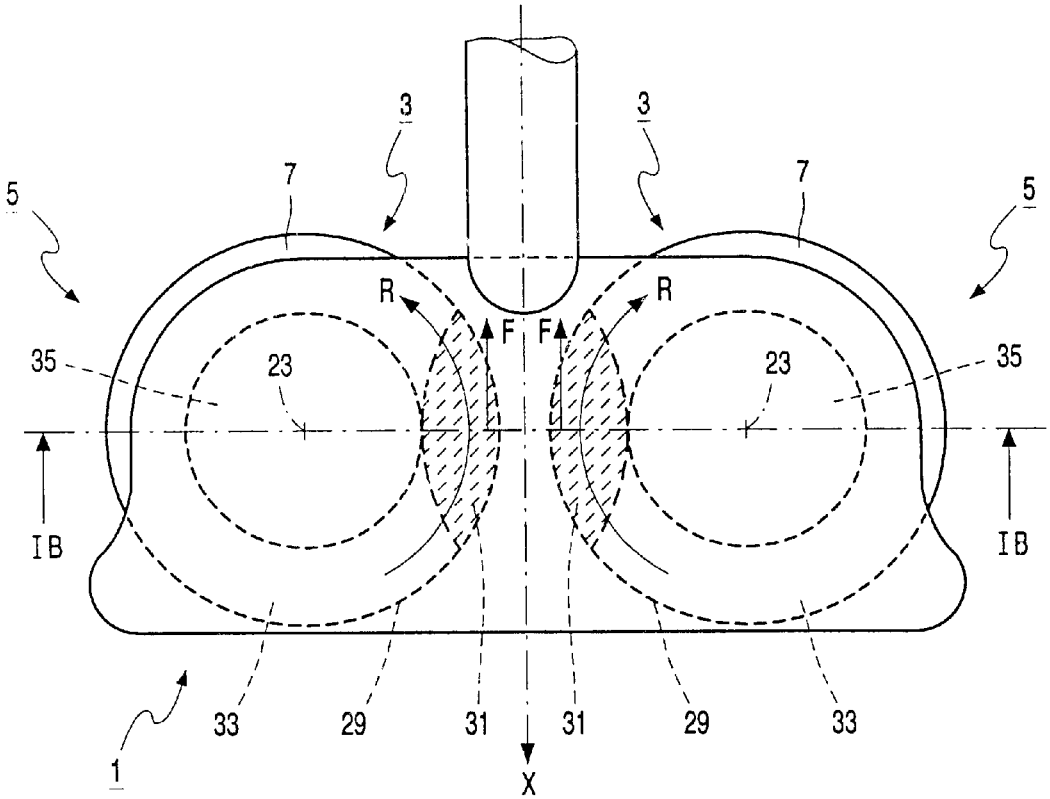
FIG. 1A PRIOR ART
FIGS. 1A and 1B are sectional views of a suction attachment of the prior art, FIG. 2 diagrammatically shows a vacuum cleaner according to the invention provided with a suction attachment with two surface-cleaning devices according to the invention.
Figure 1B:
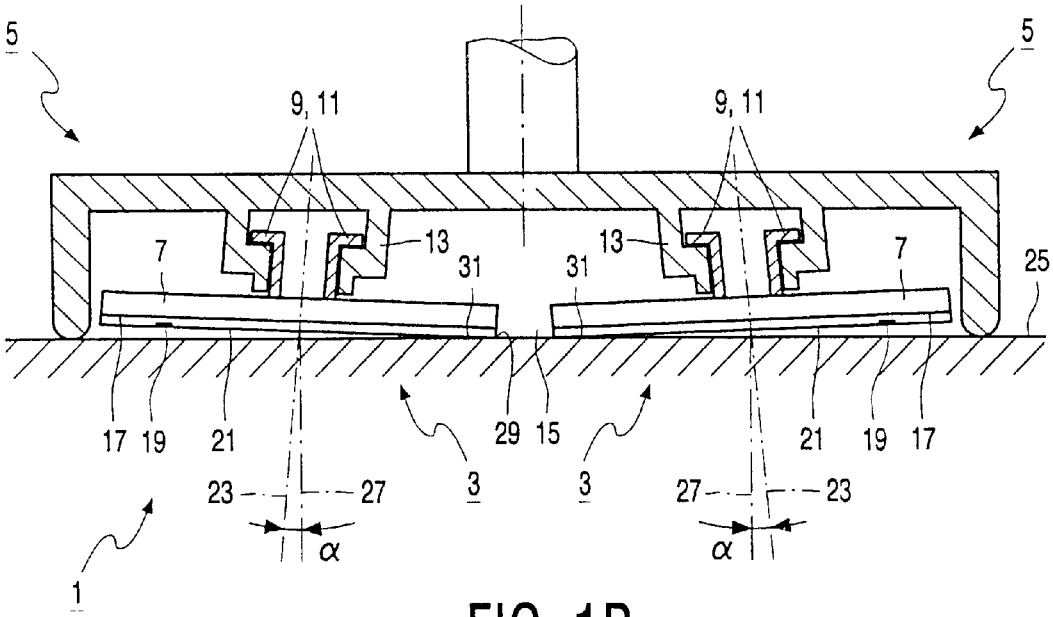
FIG. 1B PRIOR ART
Figure 2:
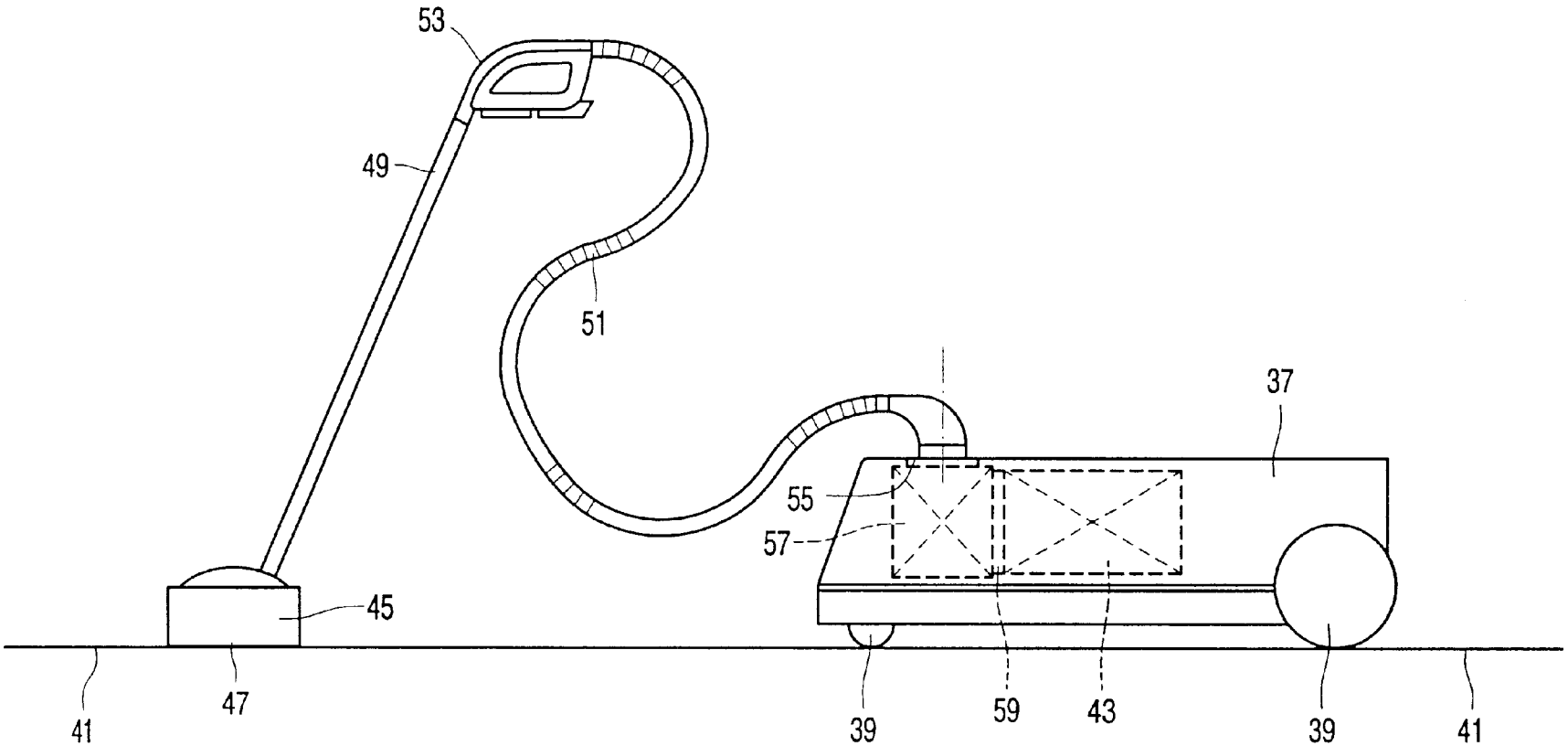

The vacuum cleaner according to the invention shown in FIG. 2 is a so-called floor-type or sliding vacuum cleaner and comprises a housing 37 which is displaceable over a surface 41 to be cleaned by means of a number of wheels 39. An electric suction unit 43, shown diagrammatically only. in FIG. 2, is accommodated in the housing 37. The vacuum cleaner further comprises a suction attachment 45 which comprises a suction opening 47 in the embodiment shown. The suction attachment 45 is detachably coupled to the housing 37 via a metal suction tube 49 and a flexible suction hose 51, said suction attachment 45 being pivotably coupled to the suction tube 49, while the suction tube 49 is detachably coupled to a tubular handle 53 fastened to the suction hose 51, and the suction hose 51 is detachably coupled to an entrance 55 of the housing 37. The entrance 55 issues into a dust chamber 57 of the housing 37, which chamber is connected to the suction unit 43 via a filter 59. During operation, the suction unit 43 generates an underpressure in a suction channel which comprises, in that order, the suction attachment 45, the suction tube 49, the handle 53, the suction hose 51, the entrance 55, and the dust chamber 57 of the vacuum cleaner. Dust and dirt particles present on the surface 41 to be cleaned are sucked through the suction opening 47 of the suction attachment 45 and through said suction channel into the dust chamber 57 by said underpressure and are collected in this chamber in an exchangeable dust bag.

Figure 3:
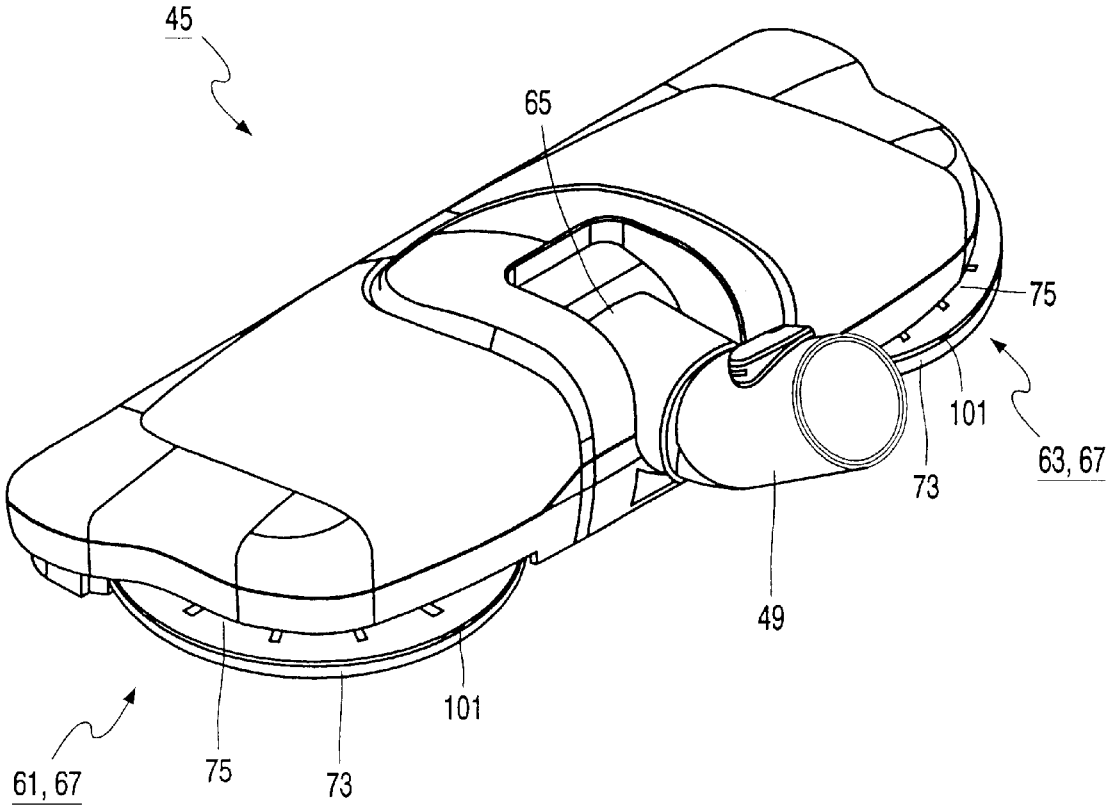
FIG. 3 shows the suction attachment of the vacuum cleaner of FIG. 2.
Figure 4:
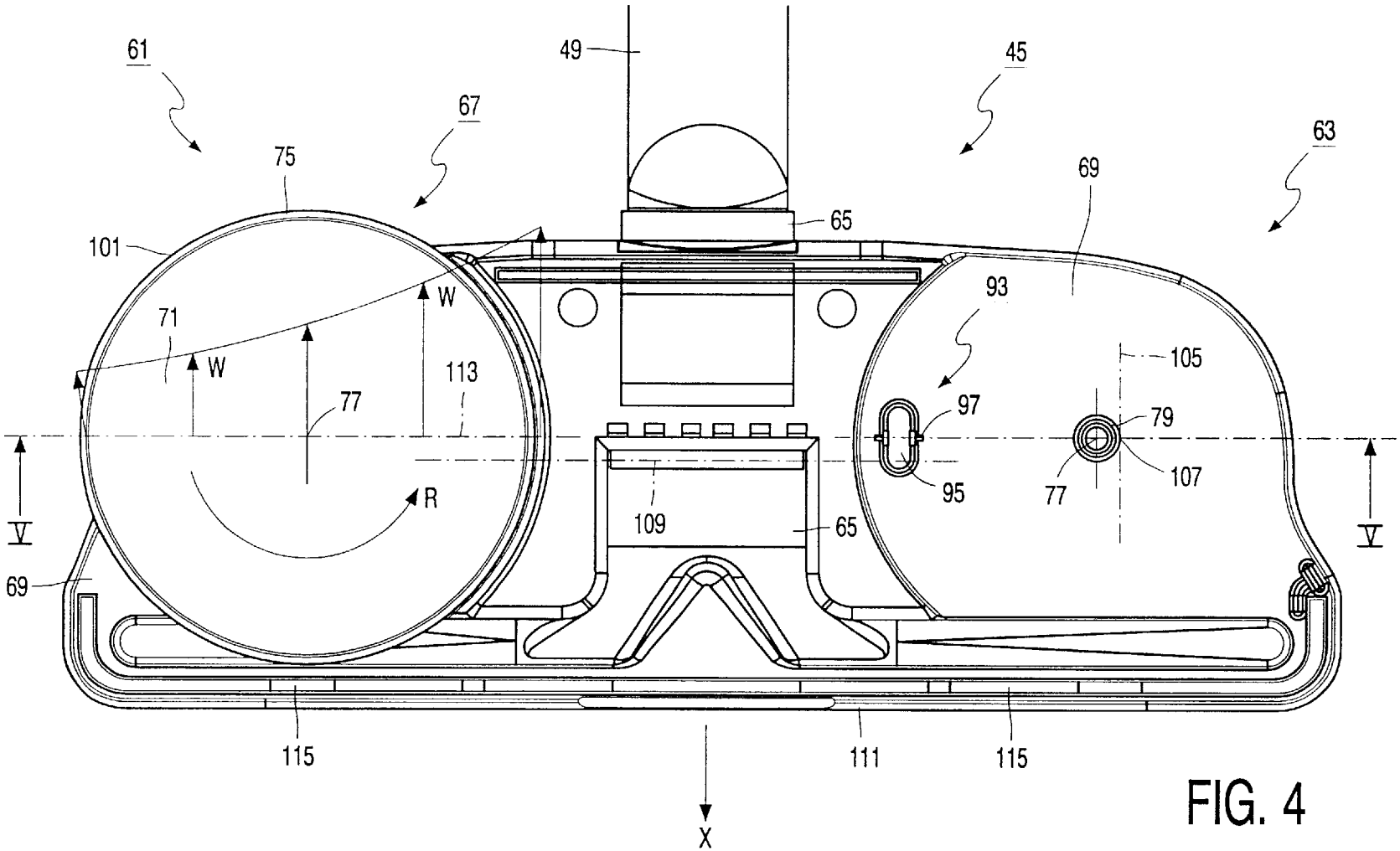
FIG. 4 is a bottom view of the suction attachment of FIG. 3.
Figure 5:
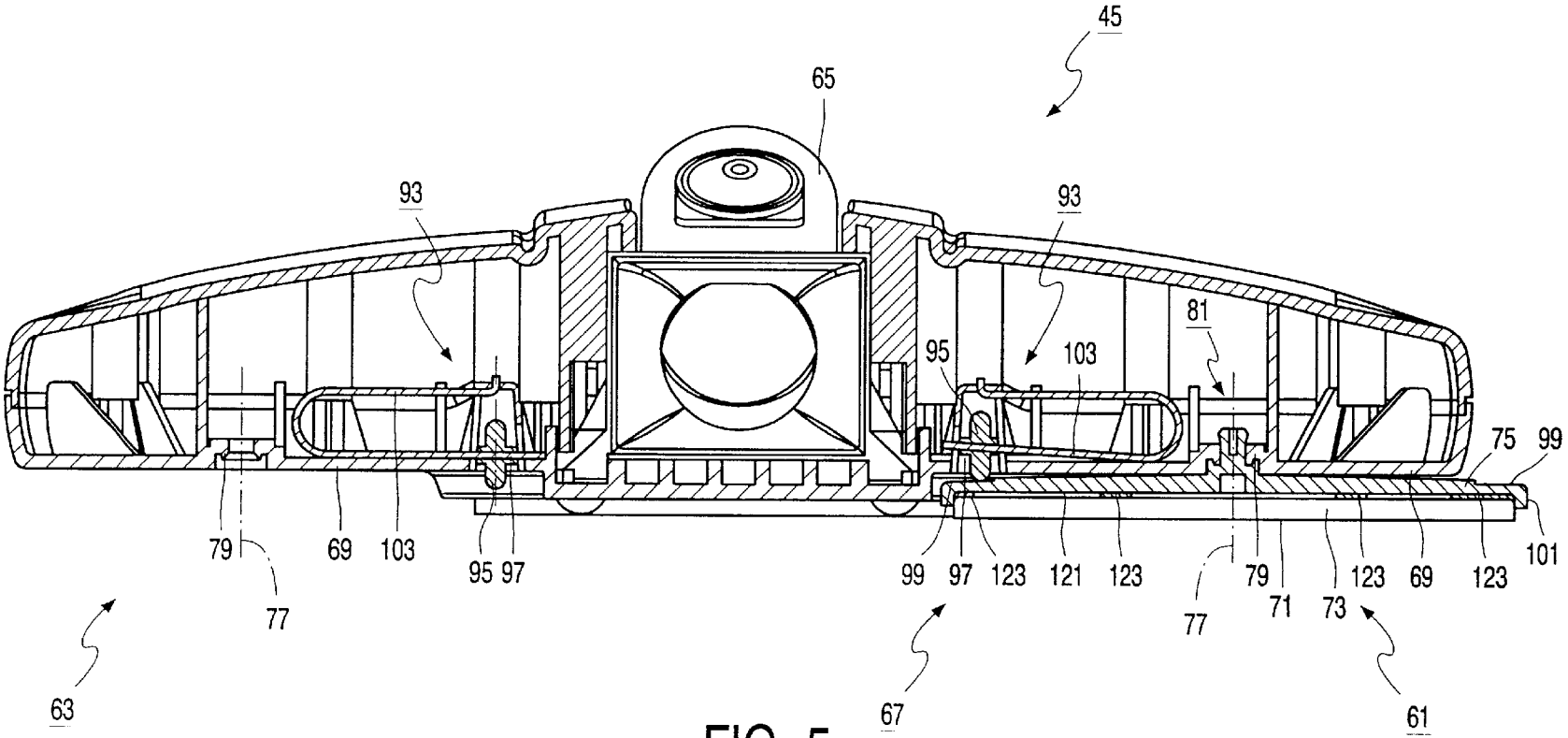
FIG. 5 is a cross-section taken on the line V—V in FIG. 4.
Figure 6:
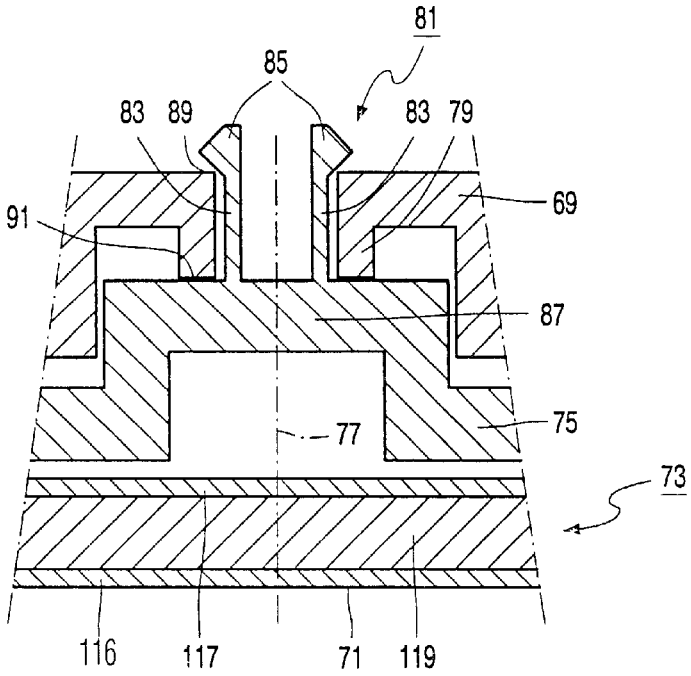
FIG. 6 shows a bearing of a rotatable cleaning element of one of the surface-cleaning devices of the suction attachment of FIG. 3, FIG. 7*a* diagrammatically shows one of the surface-cleaning devices of the suction attachment of FIG. 3 in a state in which the suction attachment is not in contact with a surface to be cleaned, and FIG. 7*b* diagrammatically shows the surface-cleaning device of FIG. 7*a* in a state in which the suction attachment is placed on the surface to be cleaned.

The suction attachment 45, which is shown in detail in FIG. 3, comprises two surface-cleaning devices 61, 63 according to the invention which are positioned on either side of a connection member 65 of the suction tube 49 on the suction attachment 45 and are each provided with a disc-shaped cleaning part 67 which is rotatably journaled in the suction attachment 45. It is noted that only the disc-shaped cleaning parts 67 of the two surface-cleaning devices 61, 63 are visible in FIG. 3. As FIGS. 4 and 5 show in detail, the surface-cleaning devices 61, 63 further comprise a base part 69 each, relative to which the cleaning part 67 is rotatably journaled. In the embodiment shown, the base part 69 is a bottom part of the suction attachment 45. It is noted that only the surface-cleaning device 61 is completely shown in FIGS. 4 and 5, whereas the cleaning part 67 of the surface-cleaning device 63 is not shown. The cleaning part 67 shown is provided with a substantially flat, circular contact surface 71 for making contact with the surface 41 to be cleaned. The contact surface 71 is present on a disc-shaped cleaning element 73 which is detachably fastened to a disc-shaped holder 75 of the cleaning part 67. The holder 75 is journaled so as to be rotatable about an axis of rotation 77, which extends substantially perpendicularly to the contact surface 71, with respect to the base part 69. The base part 69 is for this purpose provided with a bearing bush 79, and the holder 75 is provided with a bearing journal 81 which is to co-operate with the bearing bush 79. As FIG. 6 shows in detail, the bearing journal 81 comprises a number of tongues 83 which are flexible in a radial direction and which have locking studs 85. The cleaning part 67 can be removed from the base part 69 by a user in that the bearing journal 81 is pulled from the bearing bush 79 under elastic deformation of the tongues 83, and can be inserted into the base part 69 again in that the bearing journal 81 is pushed back into the bearing bush 79 under elastic deformation of the tongues 83.

As FIG. 6 shows in detail, the bearing journal 81 of the cleaning part 67 is supported with radial clearance in the bearing bush 79 of the base part 69. Seen parallel to the axis of rotation 77, the cleaning part 67 is enclosed substantially without clearance by an upper side 89 of the bearing bush 79 and a support ring 91 extending substantially perpendicularly to the axis of rotation 77 by means of the locking studs 85 and a shoulder 87 of the holder 75. In the embodiment shown, the support ring 91 is provided at a lower side of the bearing bush 79. As FIGS. 4 and 5 show, the base part 69 of each surface-cleaning device 61, 63 is further provided with means 93 for exerting a pre-tension force on the cleaning part 67. Said means 93 in the embodiment shown comprise a roller member 95 which is rotatable about a further axis of rotation 97 extending transversely to the axis of rotation 77 and which bears with pretension on a roller track 99 which extends substantially parallel to the contact surface 71. In the embodiment shown, the roller track 99 is annular and is present on an upper side of the holder 75 of the cleaning part 67 adjacent an edge 101 of the holder 75. The pre-tension of the roller member 95 in the embodiment shown is supplied by a pre-tensioned wire spring 103, while the further axis of rotation 97 of the roller member 95 is defined by an end of the wire spring 103 which extends transversely to the axis of rotation 77. A practical and simple construction of said means 93 is provided thereby, such that wear of said means 93 is limited as much as possible, while the number of components of said means 93 is limited.

Figure 7A:
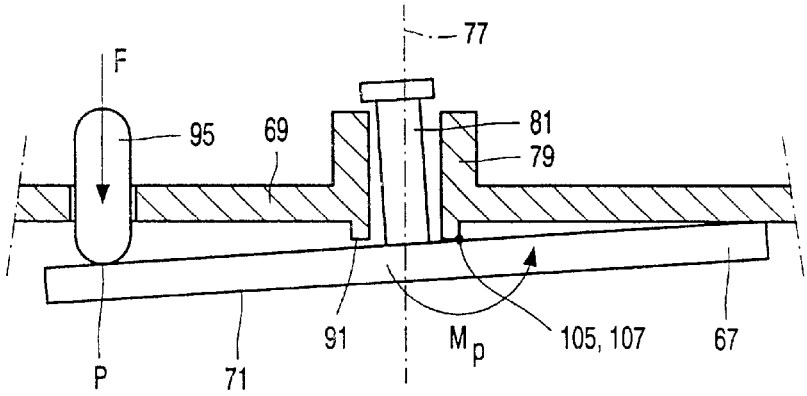
Figure 7B:
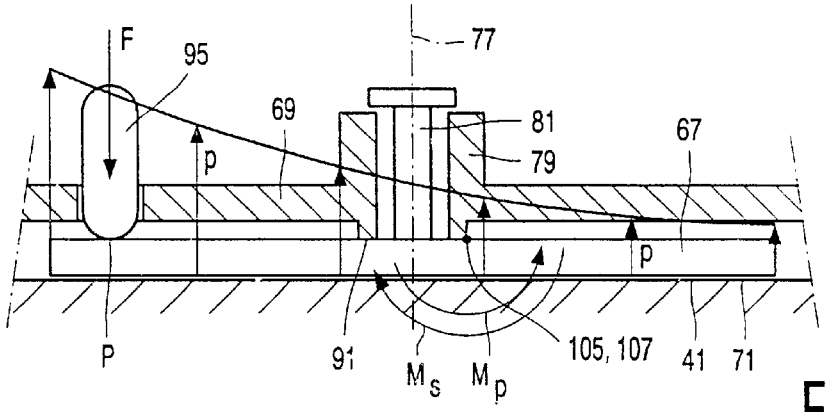

The operation of the surface-cleaning devices 61, 63 will be explained below with reference to FIGS. 7*a* and 7*b*. Since the bearing journal 81 is journaled with radial clearance in the bearing bush 79, the cleaning part 67 is pivoted relative to the base part 69 under the influence of the pre-tension force F of the roller member 95 when the suction attachment 45 is not in contact with the surface 41 to be cleaned. This state of the cleaning part 67 is diagrammatically shown in FIG. 7*a*. The pivoting movement takes place about a pivot axis 105 which extends transversely to the axis of rotation 77 and passes through a support point 107 on the support ring 91, said support point 107, as seen relative to the axis of rotation 77, being diametrically opposite a point of application P of the pre-tension force F on the cleaning part 67. The pivot axis 105 and the support point 107 are also shown in FIG. 4. FIG. 7*a* further shows a pre-tension torque $M_p$ arising from the pre-tension force F and exerted by the roller member 95 about the pivot axis 105 on the cleaning part 67. When the suction attachment 45 is placed on the surface 41 to be cleaned, the contact surface 71 of the cleaning part 67 will come into contact with the surface 41 to be cleaned, so that the cleaning part 67 is pivoted about the pivot axis 105 against the pre-tension force F of the roller member 95 into a position shown in FIG. 7*b*, in which the contact member 71 is substantially parallel to the surface 41 to be cleaned and is substantially fully in contact with the surface 41 to be cleaned. In this position, the cleaning part 67 is supported by substantially the entire support ring 91, as seen in a direction parallel to the axis of rotation 77. The pre-tension torque $M_p$ of the roller member 95 about the pivot axis 105 is compensated in this position of the cleaning part 67 by a torque $M_s$ of the same quantitative value but oppositely directed, which arises from a surface pressure p shown in FIG. 7*b* and exerted by the surface 41 to be cleaned on the contact surface 71, which pressure p is asymmetrically distributed with respect to the pivot axis 105 as a result of the pre-tension torque $M_p$. When the suction attachment 45 is moved over the surface 41 to be cleaned in a displacement direction X indicated in FIG. 4, said asymmetrical surface pressure p gives rise to a friction force W, also shown in FIG. 4, between the contact surface 71 and the surface 41 to be cleaned, which friction force is again asymmetrically distributed with respect to the pivot axis 105. Since the pivot axis 105 lies at a comparatively small distance from the axis of rotation 77, the friction force W is also asymmetrically distributed with respect to the axis of rotation 77, so that the cleaning part 67 is rotated about the axis of rotation 77 in a direction R indicated in FIG. 4 under the influence of the friction force W. No separate driving means are accordingly required for rotating the cleaning part 77, so that the surface-cleaning devices 61, 63 have a particularly simple construction. The substantially full contact between the contact surface 71 of the cleaning part 67 and the surface 41 to be cleaned leads to a substantially full utilization of the contact surface 71, so that a comparatively large portion of the surface 41 present below the suction attachment 45 is treated by the surface-cleaning devices 61, 63. The surface-cleaning devices 61, 63 have a cleaning effect which supplements the cleaning effect of the suction attachment 45 caused by the underpressure. It is noted that the distributions of said friction force W and said surface pressure p shown in FIGS. 4 and 7*b*, respectively, are shown diagrammatically and by approximation only.

When the suction attachment 45 is being moved over the surface 41 to be cleaned, the user exerts a propelling force on the handle 53 which is transmitted through the suction tube 49 to the suction attachment 45. Said propelling force usually comprises not only a horizontal but also an inadvertent vertical component. The suction tube 49 is detachably coupled to said connection member 65, which member 65 is pivotable relative to the suction attachment 45 about a pivot axis 109 which is shown in FIG. 4 and which extends substantially parallel to a front edge 111 of the suction attachment 45. Said propelling force is transmitted to the suction attachment 45 at the area of the pivot axis 109. As FIG. 4 shows, the pivot axis 109 is present between the front edge 111 and a virtual line 113 through the axes of rotation 77 of the cleaning parts 67 in the embodiment shown. It is achieved in this manner that the suction attachment 45 is supported in a stable manner by the cleaning parts 67 and a brush 115 arranged adjacent the front edge 111 under the influence of said vertical component of the propelling force, and is not tilted backwards about said line 113 in an undesirable manner as a result of the clearance of the bearing journals 81 in the bearing bushes 79.

As FIG. 6 shows in detail, the disc-shaped cleaning element 73 comprises a first layer 116 of cleaning cloth, on which the contact surface 71 is present, a second layer 117 of adhesion material for adhering the cleaning element 73 to the holder 75, and a third layer 119 of support material interposed between the first layer 116 and the second layer 117. Said cleaning cloth is manufactured from a shorthaired fiber, so that the contact surface 71 is also short-haired. A distribution of the surface pressure p between the contact surface 71 and the surface 41 to be cleaned is obtained thereby which leads to a particularly effective drive of the cleaning part 67 about the axis of rotation 77. The cleaning cloth in the embodiment shown is made from a microfiber material. It was found that such a cleaning cloth made from microfiber material has a particularly effective cleaning action, in particular in the case of rotary movements of the cleaning cloth, so that such a cleaning cloth is eminently suitable for use in the surface-cleaning devices 61, 63 according to the invention. Alternatively, however, the cleaning cloth may be manufactured from a different type of fiber such as, for example, cotton. As FIG. 5 shows, a number of adhesion elements 123 of Velcro material are provided on a lower side 121 of the holder 75. Said adhesion material of the second layer 117 of the cleaning element 73 comprises velour, which provides a very good and reliable adhesion to said Velcro material. The third layer 119 has a comparatively great thickness and imparts a comparatively high degree of stiffness to the cleaning element 73. As a result, the cleaning element 73 is easy to handle during fastening to or detaching from the holder 75. The support material from which the third layer 119 is manufactured comprises, for example, a comparatively stiff fiber type such as, for example, cotton, or a synthetic substance. The cleaning element 73 thus has a practical and simple layered structure. Since the cleaning element 73 is detachably fastened to the holder 75, the cleaning element 73 can be removed from the holder 75 after use for the purpose of, for example, cleaning or replacement by a new cleaning element. Detaching of the cleaning element 73 from the holder 75 and fastening of the cleaning element 73 to the holder 75 are further simplified in that the holder 75 is removable from the base part 69.

The vacuum cleaner according to the invention as described above is a floor-type vacuum cleaner. It is noted that the invention also relates to different types of vacuum cleaners such as, for example, upright, hand-held vacuum cleaners. In such an upright vacuum cleaner, the suction attachment is coupled to the housing, for example pivotably, which housing is in a substantially upright position when the vacuum cleaner is being used.

The surface-cleaning devices 61, 63 according to the invention described above are used in a vacuum cleaner. It is noted that a surface-cleaning device according to the invention may also be used independently. The invention thus also covers embodiments in which the base part of the surface-cleaning device is pivotably coupled to a rod, so that the surface-cleaning device can be used for cleaning floors, or in which the base part comprises a handle which is fastened in a fixed position on the base part, so that the surface-cleaning device may be used, for example, for cleaning vertical walls.

The required pivoting possibility of the cleaning part 67 in the surface-cleaning devices 61, 63 according to the invention as described above is obtained in a particularly simple and practical manner by means of the support ring 91 and the radial clearance between the bearing journal 81 and the bearing bush 79. It is noted that the invention also relates to embodiments in which the required pivoting possibility of the cleaning part with respect to the base part is obtained in a different manner. Thus, for example, the bearing journal of the cleaning part may be placed substantially without radial clearance in the bearing bush of the base part, while the bearing bush is pivotably supported with respect to the base part.

It is finally noted that the invention also relates to surface-cleaning devices in which means other than the means 93 described above are used for exerting a pre-tension torque on the cleaning part about the pivot axis. Such means may comprise, for example, a sliding member which bears with pre-tension on the upper side of the cleaning part, or, for example, contactless magnetic pre-tensioning means.

What is claimed is:

1. A surface-cleaning device comprising a base part and a cleaning part which is provided with a substantially flat contact surface for making contact with a surface to be cleaned and which is journaled so as to be rotatable relative to the base part about an axis of rotation which extends substantially perpendicularly to the contact surface, wherein the cleaning part is pivotable relative to the base part about a pivot axis which extends transversely to the axis of rotation, while the base part is provided with means for exerting a pre-tension force on the cleaning part about said pivot axis such that when the device is moved over the surface to be cleaned, the cleaning part rotates about the axis of rotation only under the influence of a friction force present between the surface to be cleaned and the contact surface.

2. The surface-cleaning device as claimed in claim 1, wherein said exerting means comprise a roller member which is rotatable about a further axis of rotation extending transversely to the axis of rotation and which bears with a pre-tension force on a roller track of the cleaning part, which roller track extends substantially parallel to the contact surface.

3. The surface-cleaning device as claimed in claim 2, wherein said exerting means comprise a wire spring, and the roller member is rotatably journaled around said wire spring adjacent an end of said wire spring.

4. The surface-cleaning device as claimed in claim 1, wherein the cleaning part is journaled with radial clearance in a bearing bush of the base part, and the base part is provided adjacent the bearing bush with a support ring which extends substantially perpendicularly to the axis of rotation and which serves to support the cleaning part in a direction parallel to the axis of rotation.

5. The surface-cleaning device as claimed in claim 1, wherein the cleaning part is provided with a holder which is journaled so as to be rotatable about the axis of rotation relative to the base part, and with a cleaning element which is detachably fastened to the holder and is provided with the contact surface.

6. The surface-cleaning device as claimed in claim 5, wherein the cleaning element is provided at least with a first layer of cleaning cloth with a short-hair contact surface and a second layer of adhesive material for adhering the cleaning element to the holder.

7. The surface-cleaning device as claimed in claim 6, wherein the cleaning element comprises a third layer of support material interposed between the first layer and the second layer.

8. The surface-cleaning device as claimed in claim 6, wherein the cleaning cloth is made from a microfiber material.

9. The surface-cleaning device as claimed in claim 6, wherein the adhesive material comprises velour for adhesion to a Velcro material provided on the holder.

10. A vacuum cleaner provided with a housing in which a suction unit is present and with a suction attachment which is coupled to the suction unit via a suction channel and includes a surface-cleaning device, wherein the surface-cleaning device is a surface-cleaning device as claimed in claim 1.

11. The vacuum cleaner as claimed in claim 10, wherein the suction channel comprises a suction tube which is pivotable about a pivot axis with respect to the suction attachment, which pivot axis extends substantially parallel to a front edge of the suction attachment and lies between the front edge and the axis of rotation of the cleaning part.

12. A surface-cleaning device comprising a base part and a cleaning part which is provided with a substantially flat contact surface for making contact with a surface to be cleaned and which is journaled so as to be rotatable relative to the base part about an axis of rotation which extends substantially perpendicularly to the contact surface, wherein the cleaning part is pivotable relative to the base part about a pivot axis which extends transversely to the axis of rotation, while the base part is provided with means for exerting a pre-tension torque force on the cleaning part about said pivot axis such that when the device is moved over the surface to be cleaned, the cleaning part rotates about the axis of rotation only under the influence of a friction force present between the surface to be cleaned and the contact surface.

13. The surface-cleaning device as claimed in claim 12, wherein said exerting means comprise a roller member which is rotatable about a further axis of rotation extending transversely to the axis of rotation and which bears with a pre-tension force on a roller track of the cleaning part, which roller track extends substantially parallel to the contact surface.

14. The surface-cleaning device as claimed in claim 13, wherein said exerting means comprise a wire spring, and the roller member is rotatably journaled around said wire spring adjacent an end of said wire spring.

15. The surface-cleaning device as claimed in claim 12, wherein the cleaning part is journaled with radial clearance in a bearing bush of the base part, and the base part is provided adjacent the bearing bush with a support ring which extends substantially perpendicularly to the axis of rotation and which serves to support the cleaning part in a direction parallel to the axis of rotation.

16. The surface-cleaning device as claimed in claim 12, wherein the cleaning part is provided with a holder which is journaled so as to be rotatable about the axis of rotation relative to the base part, and with a cleaning element which is detachably fastened to the holder and is provided with the contact surface.

17. The surface-cleaning device as claimed in claim 16, wherein the cleaning element is provided at least with a first layer of cleaning cloth with a short-hair contact surface and a second layer of adhesive material for adhering the cleaning element to the holder.

18. The surface-cleaning device as claimed in claim 17, wherein the cleaning element comprises a third layer of support material interposed between the first layer and the second layer.

19. A vacuum cleaner provided with a housing in which a suction unit is present and with a suction attachment which is coupled to the suction unit via a suction channel and includes a surface-cleaning device, wherein the surface-cleaning device is a surface-cleaning device as claimed in claim 12.

20. The vacuum cleaner as claimed in claim 19, wherein the suction channel comprises a suction tube which is pivotable about a pivot axis with respect to the suction attachment, which pivot axis extends substantially parallel to a front edge of the suction attachment and lies between the front edge and the axis of rotation of the cleaning part.

* * * * *